United States Patent [19]

Nerlich et al.

[11] Patent Number: 4,487,531

[45] Date of Patent: Dec. 11, 1984

[54] TRAVELLING BRACKET

[75] Inventors: Ernst-Günter Nerlich, Essen; Hans-Ferdinand Bemmerl, Herne; Peter Kröninger, Gelsenkirchen, all of Fed. Rep. of Germany

[73] Assignee: Bochumer Eisenhütte Heintzmann GmbH & Co. KG, Bochum, Fed. Rep. of Germany

[21] Appl. No.: 433,807

[22] Filed: Oct. 8, 1982

[30] Foreign Application Priority Data

Dec. 18, 1981 [DE] Fed. Rep. of Germany ..... 3150127

[51] Int. Cl.[3] ..... E21D 23/00

[52] U.S. Cl. ..... 405/291; 299/43; 405/290

[58] Field of Search ..... 405/291–296; 299/43, 33

[56] References Cited

U.S. PATENT DOCUMENTS

| | | | |
|---|---|---|---|
| 4,045,089 | 8/1977 | Hauschopp et al. | 405/291 X |
| 4,048,804 | 9/1977 | Elsner et al. | 405/296 X |
| 4,266,891 | 5/1981 | Plevak et al. | 405/293 X |
| 4,313,698 | 2/1982 | Maykemper et al. | 405/296 |
| 4,327,946 | 5/1982 | Kirchbrucher et al. | 299/43 X |
| 4,352,602 | 10/1982 | Plaga | 405/291 |

FOREIGN PATENT DOCUMENTS 2650351 11/1976 Fed. Rep. of Germany .

*Primary Examiner*—Dennis L. Taylor
*Attorney, Agent, or Firm*—Michael J. Striker

[57] ABSTRACT

A trough-shaped travelling bracket of a retracting and guiding arrangement of a mine roof support has fixing elements at its mine-face end for releasably coupling with an abutment, wherein the fixing elements are exchangeable, but fixedly connectable with a web of the travelling bracket.

6 Claims, 12 Drawing Figures

2
1
6
4
11
9
11
7
10
11
3
5
8
13
23
24
15
12
14
27
22
21
25
30
26
29
31

6
6
11
10
11
9
7
8
13
24
24
19
18
20
15
17
23
14
24
24
16
22
21
26
25
29
30
28
26

TRAVELLING BRACKET

BACKGROUND OF THE INVENTION

The present invention relates to a trough-shaped travelling bracket which is a component of a retracting and/or guiding arrangement incorporated in a mine support. More particularly, it relates to a trough-shaped travelling bracket which has a web flatly lying on a mine floor in the region of a travelling path and is provided with fixing elements at its mine-face side for releasably coupling with an abutment displacing in a longitudinal direction of the mine.

Travelling brackets of the above mentioned general type are known in the art. One such travelling bracket is disclosed, for example, in German Offenlegungsschrift No. 2,650,351. The travelling bracket forms a bridging member between a mine support, for example a mine roof support, and an abutment displacing in a longitudinal direction of the mine, for example a mine conveyor or a retracting beam, so as to considerably facilitate the mine guidance. With respect to fixing elements associated with the travelling bracket, the travelling bracket specifically corresponds to the spatial operational situation. The fixing element includes a supporting shackle and a turning cylinder-and-piston unit, so that the abutment formed by a mine conveyor can be turned for level control of the tool guided on the mine conveyor. When during the process of progressing excavation this spatial operational situation is changed, for example so that another fixing element is required, the entire travelling bracket must be exchanged. As a rule, parts of the retracting and/or guiding arrangement connected with the travelling bracket at its mine-filling side must also be exchanged. Such an exchange can be required, for example, when the excavation method and/or the geological properties make unnecessary lifting or lowering of the abutment with respective action on the excavation device guided on the abutment or another turning drive is necessary. Expenditures connected with such an exchange are very high. The exchange works are difficult, inasmuch as they must be performed in a very narrow space. This is especially difficult when the stratum thickness decreases to a value range of 1 m and less. In addition to this, there are a great variety of types of abutments which prevent utilization of a travelling bracket with fixedly connected fixing elements as components of a retracting and/or guiding arrangement integrated in a mine support, which can be stored and then brought from the abutment back into the working location.

SUMMARY OF THE INVENTION

Accordingly, it is an object of the present invention to provide a trough-shaped travelling bracket of a retracting and/or guiding device of a mine support, which avoids the disadvantages of the prior art.

More particularly, it is an object of the present invention to provide a travelling bracket of a retracting and/or guiding device of a mine support, which in extremely difficult underground conditions, such as for example a narrow gallery, can be adjusted to the respective spatial conditions without considerable expenditures of time, material, and staff.

In keeping with these objects, and with others which will become apparent hereinafter, one feature of the present invention resides, briefly stated, in a travelling bracket having a web and fixing elements, wherein the fixing elements are connected with the web exchangeably but at the same time rigidly.

When the fixing elements are connected exchangeably with the web lying narrowly on the mine floor, the eventual exchange works are transferred, even in the event of a small stratum thickness, from a travelling path to a region which is relatively problem-free. The parts to be exchanged when necessary are thereby smaller and considerably easier to manipulate in conditions existing in underground excavations. The remaining parts of the travelling bracket, as well as the retracting and/or guiding arrangement remain in the event of a required exchange at the same place. There is a further advantage that it is possible to adjust the travelling bracket to abutments of all shapes without problems and without spending considerable time and labor, inasmuch as the fixing elements are exchangeable. The plurality of types can be first taken into consideration. Particularly, the respective spatial mine face conditions can obviate to be counted. By respectively designed fixing elements the distance of the cap tip of a mine support from a coal face can be varied in a suitable manner.

In accordance with another advantageous feature of the present invention, the connection between the fixing elements and the web is comb-like, and the web has a comb-like formation interengaging in a form-locking manner with counter comb-like formations on the fixing elements. The comb-like formation, for example, at the mine-face side of the web and the respective counter comb-like formation on the fixing elements guarantees that these comb-like formations remains within the thickness of the web. The travelling cross section is not reduced, so that the inventive features are particularly suitable for strata with small thickness.

In accordance with still another advantageous feature of the present invention, the comb-like formation of the web and the counter comb-like formation of the fixing elements includes at least two teeth. This leads to a stable rigid connection, without requiring special expenditures for the manufacture.

The comb-like connection is formed without play in such a manner that the comb-like formation of the web and the counter comb-like formation of the fixing elements are rigidified by at least two transverse pins located near and at a distance from one another. The transverse pins can extend through the entire width of the comb-like connection. It is however advisable to use short transverse pins which are inserted from one side in a region which is defined by the vertical central longitudinal plane of the travelling bracket. In this case four transverse pins can be used.

In accordance with a further advantageous feature of the present invention, the web is plate-shaped and has three teeth, whereas the counter comb-like formations have two teeth.

In accordance with still a further advantageous embodiment of the invention, the web is formed as two laterally offset strip-shaped beams each provided at their mine-face side with two teeth, whereas the counter comb-like formation of the fixing element is also provided with two teeth.

In this case, a retracting and/or guiding arrangement is provided in which, between both beams, a displacing rod in a fixed region of the beams is arranged. The displacing rod is connected at a mine-filling side with at least one flatly lying lifting cylinder-and-piston unit and at mine-face side is fixed above and below at a lateral side of the abutment. In dependence upon the fixing point of the displacing rod, the fixing point of the fixing elements are provided above or below the abutment. In this manner, a level control of an excavation machine can take place from the mine-filling side without reducing the travelling cross section. Simultaneously, the invention makes possible the exchange of the fixing elements and also the displacing rod in dependence upon the spatial considerations.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
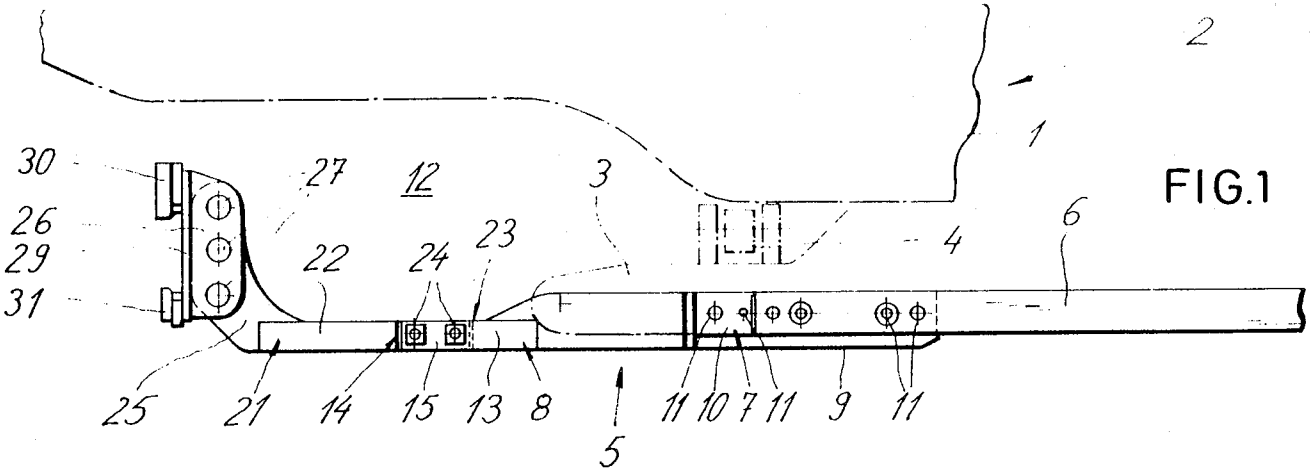
FIG. 1 is a side view of a mine roof support with a retracting and guiding arrangement with a plate-shaped travelling bracket.

In FIG. 1 a cap of a not shown mine roof support 2 is schematically illustrated and identified with reference numeral 1. Reference numeral 3 identifies skis of the mine roof support 2 arranged at a distance near one another. The skis 3 are connected with one another at their end facing toward a mine face by a transverse bracket 4 for limited pivoting.

Figure 2:
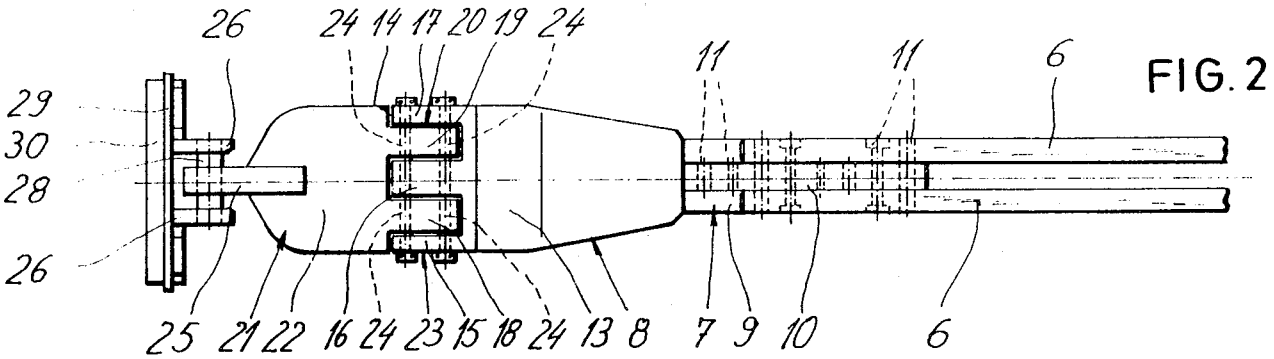
FIG 2 is a plan view of the retracting and guiding arrangement of FIG. 1.

As can be seen from joint consideration of FIGS. 1 and 2, a retracting and guiding arrangement 5 is located between both skis 3 and has two guide rods 6 and directed toward the mine-filling. The guide rods 6 are connected in a not shown manner via a hydraulically actuated cylinder-and-piston unit with the mine roof support 2. For example, the cylinder-and-piston unit can be introduced between the mine filling end of the retracting and guiding arrangement 5 at the bracket 4 connecting the skis 3 with limited pivoting.

Both guide rods 6 which extend at a lateral distance from and parallel to one another surround a projection 7 of a plate-shaped travelling bracket 8. The projection 7 has a T-shaped cross section. A flange 9 of the projection 7 is supported on a floor, whereas a central web 10 is directed toward the roof. Transverse recesses 11 are formed in the web 10 and the guide rod 6 for not shown screw pins and centering pins.

A web 13 of the travelling bracket 8, which lies in a travelling path 12, is flat and tightly lies on the floor. An end side 14 of the web 13, facing toward the mine face, is comb-like. It has three teeth 15, 16 and 17. Teeth 18 and 19 of a counter toothing 20 engages between the teeth 15, 16 and 17. The toothing 20 is a component of a fixing element 21. The portion 22 of the fixing element 21, which carries the counter toothing 20 is formed flat in a plate-like manner and tightly lies on the floor. As a result of this, the travelling path 12 is provided between the roof cap 1 of the mine roof support 2 and the travelling bracket 8, which makes possible travelling even in the event of a very low stratum thickness.

The reinforcement of the counter toothing 20 with a comb web 23 is performed by four pins 24 which extend transversely through the teeth 15, 16, 17, 18 and 19.

A central shackle 25 extends at the end of the plate-like part 22 in a somewhat arc-shaped guide upwardly and engages between two ribs 26 which are laterally spaced from one another and directed toward the mine filling. The ribs 26 and the shackle 25 have openings 27 corresponding to one another for introducing a pivot pin 28. The ribs 26 form a component of an element 29 with two guide strips 30 and 31 at the mine-face side. The guide strips 30 and 31 are arranged at a distance above one another and engage respectively designed strips at the lateral wall of a support formed, for example, by a not shown conveyor, in a clamping manner.

Figure 3:
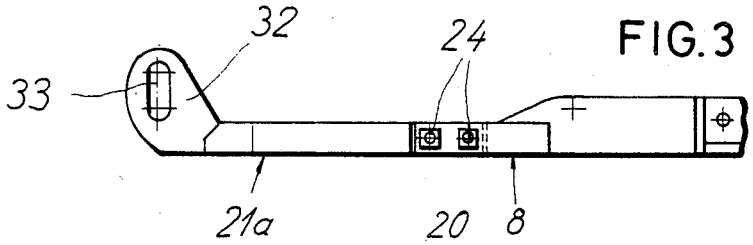
FIGS. 3–6 are side and plan views of a travelling bracket in accordance with further embodiments of the present invention.
Figure 4:
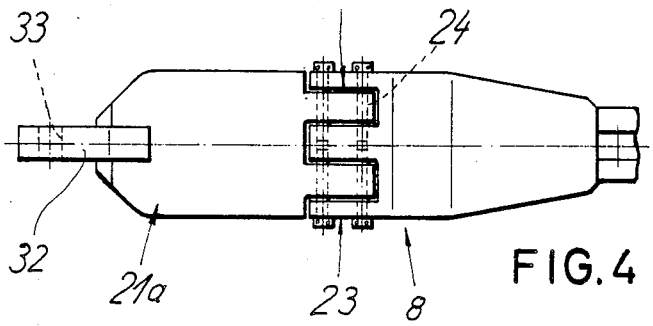

FIGS. 3 and 4 show one embodiment of the travelling bracket 8 which substantially corresponds to the travelling bracket 8 of FIGS. 1 and 2. In contrast to the latter, a fixing element **21*a* has at its mine-face side only one upwardly directed shackle 32 with an elongated opening 33**.

Figure 5:
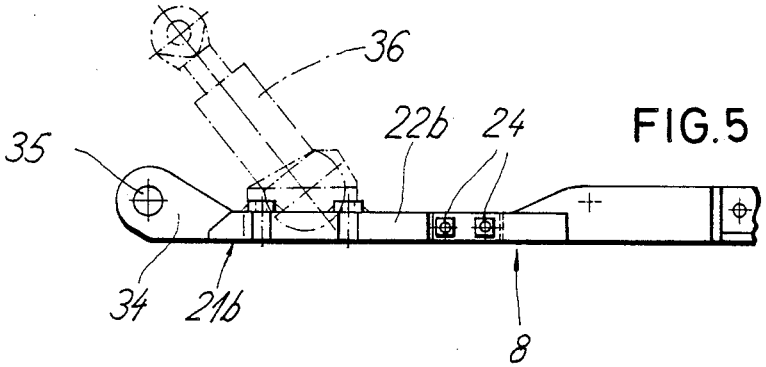
Figure 6:
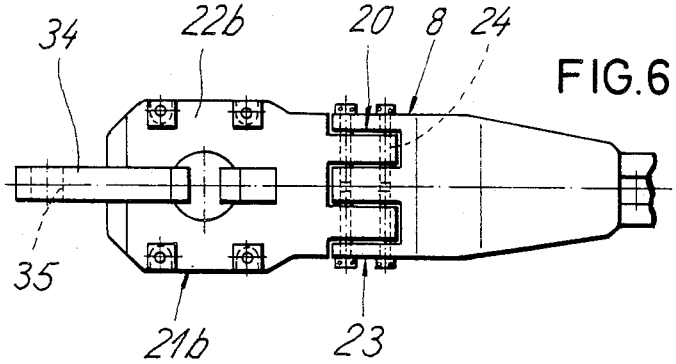

In a fixing element **21*b* of the travelling bracket 8 in FIGS. 5 and 6, in addition to a shackle 34 with a hinge ear 35 on a plate 22*b* of the element 21*b*, in some cases a turning cylinder-and-piston unit 36 can be supported, which can be coupled with an abutment in a vertical region different from the vertical region of the hinge ear 35. The possibility of introducing the above mentioned turning cylinder-and-piston unit 36 is shown in broken lines in FIG. 5**.

Figure 7:
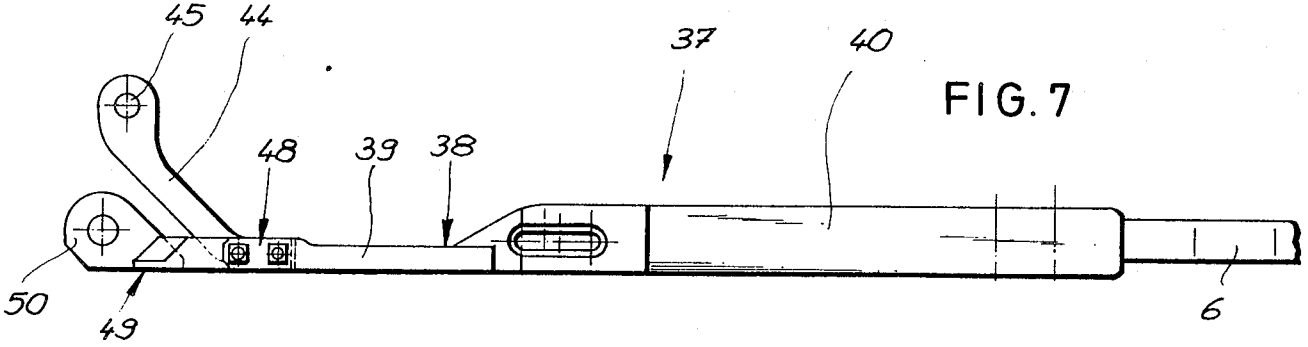
FIG. 7 is a view showing a further embodiment of a retracting and guiding arrangement with a double-beam travelling bracket and a displacing rod.
Figure 8:
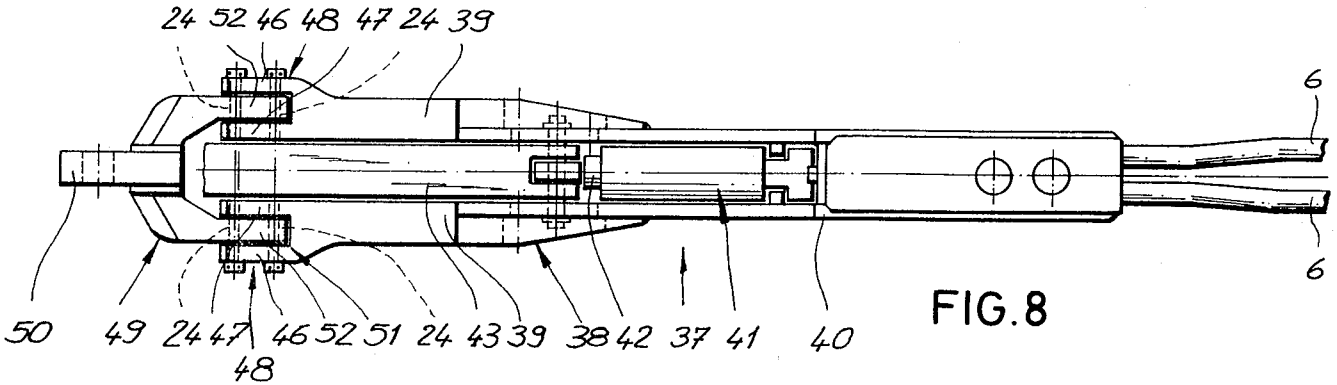
FIG. 8 is a plan view of the retracting and guiding arrangement of FIG. 7.

The embodiments of FIGS. 1–6 show that it is possible to exchange different elements 21, **21*a*, 21*b* of the travelling bracket 8 also in very low stratum thicknesses in dependence upon the respective spatial conditions. It suffices for this purpose to release the counter toothing 20 from the comb web 23 and after exchange of the fixing element again connect the same with one another by the transverse pins 24. FIGS. 7 and 8 show a retracting and guiding arrangement 37 in which a travelling bracket 38 has two beams 39 laterally spaced from one another. These beams 39** are also flat and tightly lie on the floor.

The beams 39 are connected with a housing 40. Guide rods 6 shown in FIGS. 1 and 2 are inserted and fixed in the housing 40 at its mine-filling end. The housing 40 serves also for receiving a horizontally extending turning cylinder-and-piston 41. A piston rod 42 of the cylinder-and-piston unit 41 is connected with a displacing rod 43 with vertical pivoting. The displacing rod 43 lies in a thick region of the beams 39 between them and ends at the mine-face end with a somewhat arcuate-shaped path in a shackle 44 extending toward the roof and provided with a hinge ear 45. The hinge ear 45 serves for fixing on an abutment.

The beams 39 are formed at their mine-face end in a fork-like manner. A fixing element 49 engages between teeth 46 and 47 of a thus formed comb web 48. The fixing element 49 is also flat as the beams 39 and has a web-like bearing ear 50 for fixing on an abutment. The connection of the counter toothing 51 of the fixing element 49 with the comb web 48 is performed again by the pins 24 which are introduced through the teeth 46, 47 and 52 from one side.

Figure 9:
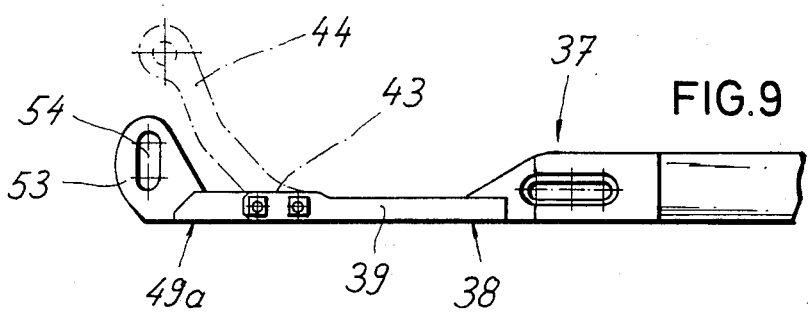
FIGS. 9–12 are side and plan views of a double-beam travelling bracket in accordance with further embodiments of the invention.
Figure 10:
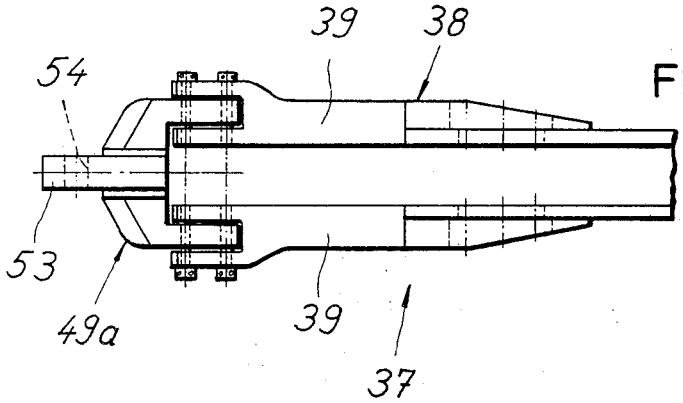

FIGS. 9 and 10 show a further embodiment of the travelling bracket 38 associated with the retracting and guiding arrangement 37 of FIGS. 7 and 8. An element 49*a* of the travelling bracket 48 has only one fixing ear 53 with a vertical elongated hole 54. Broken lines show that in some cases a displacing rod 43 with a fixing shackle 44 can be inserted between the beams 39 of the travelling bracket 38. The connection of the element 49*a* with the beams is performed in the manner shown in FIGS 7 and 8.

Figure 11:
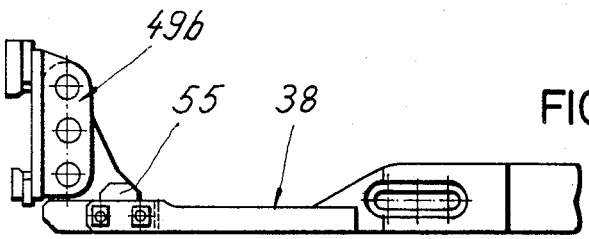
Figure 12:
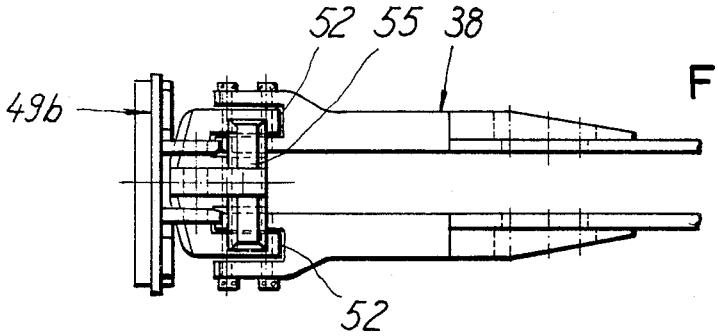

FIGS. 11 and 12 show the utilization of the travelling bracket 38 known from FIGS. 7 and 8 with an element 49*b* which is known in principle from FIGS. 1 and 2. For reinforcing purposes, both teeth 52 of the element 42*b* are connected with one another by a transverse web 55. Also in the embodiments of FIGS. 7–12 it can be seen that each fixing element 49, 49*a* and 49*b* can be exchanged by another fixing element, so that it is not necessary to completely dismount the travelling bracket 38 or the retracting and guiding arrangement 37.

It will be understood that each of the elements described above, or two or more together, may also find a useful application in other types of constructions differing from the types described above.

While the invention has been illustrated and described as embodied in a travelling bracket of a mine roof support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that from the standpoint of prior art, fairly constitute essential characteristics of the generic or specific aspects of this invention.

What is claimed as new and desired to be protected by Letters Patent is set forth in the appended claims:

1. A travelling bracket of a retracting and/or guiding device of mine support, particularly of a mine roof support, the travelling bracket comprising a web flatly lying on a mine floor in a travelling path and having a mine face side; and fixing elements provided at said mine face side of said web and arranged for releasably coupling with an abutment longitudinally displacing in a mine; and means for exchangeably but at the same time rigidly connecting said fixing elements to said web.

2. A travelling bracket as defined in claim 1; said connecting means being comb-like and including a comb-like formation in said web and a counter comb-like formation in said fixing elements form-lockingly engaging with said first-mentioned comb-like formation.

3. A travelling bracket as defined in claim 2, wherein said first-mentioned comb-like formation and said counter comb-like formation have at least two teeth.

4. A travelling bracket as defined in claim 2, and further comprising at least two pins which are located at a distance from one another and extend through said first-mentioned comb-like formation and said counter comb-like formation to provide rigid connection with each other.

5. A travelling bracket as defined in claim 1, wherein said web in plate-shaped and said first-mentioned comb-like formation has three teeth at a mine face side of said plate-shaped web, said counter comb-like formation of said fixing elements having two teeth.

6. A travelling bracket as defined in claim 1, wherein said web includes two laterally offset strip-shaped beams forming said first-mentioned comb-like formation and each having two teeth, said counter comb-like formation of said fixing elements also having two teeth engaging therewith.

* * * * *